United States Patent [19]

Andoniev et al.

[11] 4,026,352

[45] May 31, 1977

[54] DEVICE FOR EVAPORATIVE COOLING OF METALLURGICAL UNITS

[76] Inventors: Sergei Mikhailovich Andoniev, prospekt Pravdy, 5, kv. 60; Gennady Alexandrovich Kudinov, prospekt Gagarina, 32 kv. 203; Dorina Borisovna Kutsykovich, prospekt Lenina, 39 kv. 54; Grigory Ivanovich Kasyanov, prospekt Lenina, 64-b, kv. 63; Jury Borisovich Raikovsky, prospekt Lenina, 11, kv. 34; Oleg Vladimirovich Filipiev, prospekt Pravdy, 5, kv. 4, all of Kharkov; Evgeny Zakharovich Freidenzon, ulitsa Lunacharskoga, 161, kv. 23, Sverdlovsk; Vladimir Semenovich Pustovar, ulitsa Otakara Yarosha, 5, kv. 37, Kharkov, all of U.S.S.R.

[22] Filed: Sept. 4, 1974

[21] Appl. No.: 502,947

[52] U.S. Cl. ..... 165/95; 122/7 R; 122/379; 165/101; 266/193

[51] Int. Cl.[2] ..... F28G 9/00

[58] Field of Search ..... 266/193; 165/101, 95; 122/379, 6 R, 6 B, 6.6, 7 R

[56] References Cited

UNITED STATES PATENTS

| | | | |
|---|---|---|---|
| 1,854,288 | 4/1932 | Bancel et al. | 165/101 |
| 3,586,487 | 6/1971 | Juhasz et al. | 165/101 X |
| 3,693,708 | 9/1972 | Andoniev et al. | 266/32 X |
| 3,704,747 | 12/1972 | Andoniev et al. | 266/32 X |

*Primary Examiner*—Albert W. Davis, Jr.

[57] ABSTRACT

A device which is a natural circulation cooling water system, comprising coolers made up of several rows of vertical tubes for cooling water, a header supplying cooling water to said tubes from a separating tank, being referred hereinafter to as a separator, and a header discharging steam-water mixture from the coolers to the separator.

Both the inlets and outlets of the rows of the cooler tubes are in addition individually connected through cutoff means to a service water supply pipe and to a drain pipeline accordingly. The cutoff means are designed so that when they are placed in one position the tubes are connected to the cooling water natural circulation system while in another position they are coupled to a service water cooling system.

1 Claim, 1 Drawing Figure

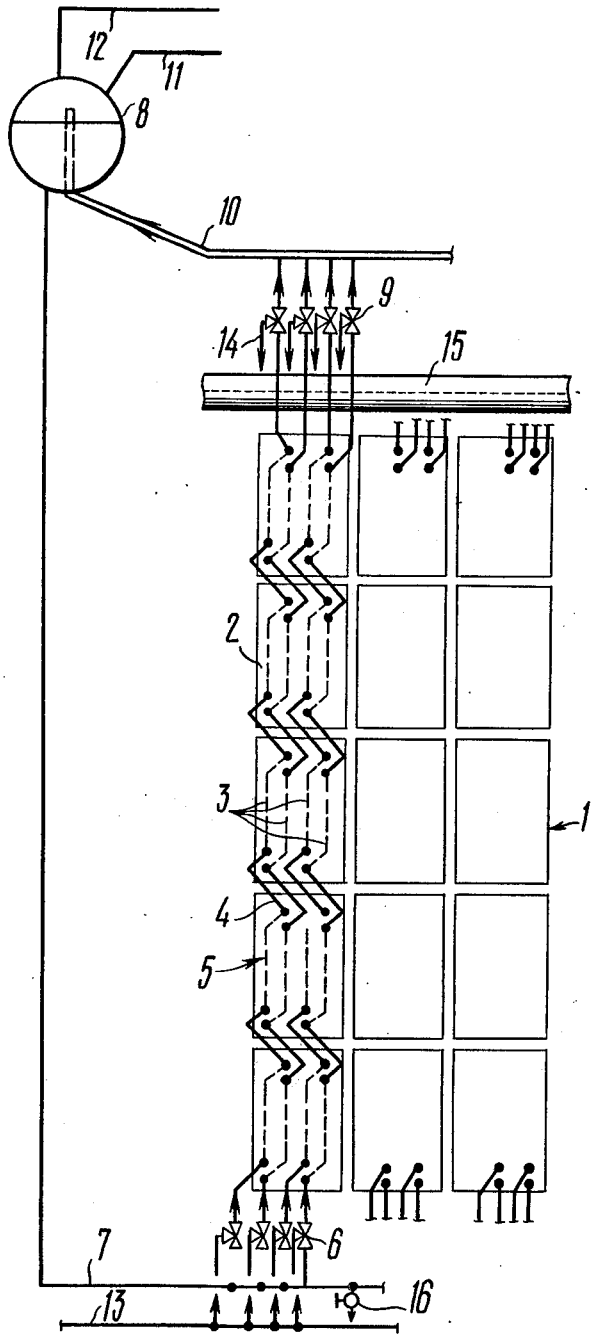
12
11
8
10
9
14
15
2
3
1
4
5
7
6
13
16

DEVICE FOR EVAPORATIVE COOLING OF METALLURGICAL UNITS

The present invention relates to ferrous metallurgy and more particularly to devices for evaporative cooling of metallurgical units. It may prove to be most advantageous for cooling blast furnaces, valves of blast furnace air heaters, etc.

Widely known in the art is a device for evaporative cooling of metallurgical unit, comprising a closed natural circulation cooling water system.

The prior-art device includes coolers accommodating each several vertical rows of rigidly fixed tubes in which cooling water is flowing. The inlets of said tubes are connected to pipelines supplying cooling water therein from a separating tank, referred to hereinafter as a separator, their outlets being connected to pipelines discharging steam-water mixture from said cooler tubes to the separator.

To cover losses in water discharged from the separator in the form of steam, feedwater is fed to the separator.

The pipelines for supplying cooling water to the coolers as well as those for discharging steam-water mixture therefrom are connected to downtake and uptake headers accordingly.

If one or a plurality of rows of the tubes in one of the coolers fail, the coolers should be disconnected from the evaporative cooling system for carrying out repair work, and changed over to cooling with service water.

To this end a service water pipeline is connected to the downtake header and a drain pipeline to the uptake header.

Both the downtake header and service water pipeline are fitted with gate valves enabling water to be admitted into the coolers from the service water pipeline.

The uptake header is also provided with a gate valve which makes it possible to discharge cooling water to the drain pipeline.

Thus, when one or several rows of the tubes in one of the coolers fail, the entire group of the coolers connected to the common downtake and uptake headers must be disconnected from the evaporative cooling system. Prolonged disconnection of the coolers from the evaporative cooling system may result in over-heat and early failure of the entire group of the coolers.

The main object of the present invention is to provide a device for evaporative cooling of metallurgical units whose inherent design would enable in case of failure of one or several rows of cooler tubes only damaged tube rows to be disconnected from the evaporative cooling system.

Said object is achieved by providing a device for evaporative cooling of metallurgical units comprising a closed natural circulation cooling water system which includes coolers with several rows of vertical tubes wherein cooling water is flowing with the tube inlets being connected to a header for supplying cooling water from a separator, and the outlets to a header for discharging steam-water mixture into the separator, and a service water cooling system consisting of a service water supply pipeline and a drain line with the tube inlets and outlets being, according to the invention, connected in addition individually to the service water supply and drain pipelines accordingly through cutoff means made so that when they are placed in one position the tubes are connected to the natural circulation water cooling system and in another position to the service water cooling system.

Owing to the above embodiment of the proposed device only the damaged tubes can be disconnected from the evaporative cooling system if one or several rows of the cooler tubes fail.

According to one of the possible embodiments, the invention may envisage the use of three-way valves as said cutoff means.

The present invention will be better understood from a consideration of a detailed description of an exemplary embodiment thereof, to be had in conjunction with the accompanying drawing, wherein is shown a layout of a device for evaporative cooling of metallurgical units, according to the invention.

A device for evaporative cooling, comprising coolers 1 absorbing heat liberated during the technological process.

With this embodiment each cooler 1 is provided with a plurality of cast iron cooling plates 2 arranged intermediate of the unit shell and brickwork along the unit height (not shown in the drawing). Each cooling plate 2 incorporates several vertical tubes 3 for cooling water, the tubes being introduced into the plate 2 and rigidly fixed therein. The tubes 3 of a vertical row of the cooling plates 2 are coupled with one another vertically in series with the aid of connecting tubes 4. Thus, each cooler 1 has several vertical rows 5 made up of the tubes 3 and 4.

Mounted at an inlet of each vertical row 5 of the tubes 3 and 4 is a three-way valve 6 through which the tube rows 5 are connected to headers 7 for supplying cooling water to the tubes from a separator 8.

Each outlet from the row 5 of the tubes 3 and 4 is also provided with a three-way valve 9 through which said tubes are coupled with a header 10 for discharging steam-water mixture, that is formed when the cooling plates 2 of the cooler 1 absorb a heat flux, to the separator 8 adapted for separating steam from water. Connected to the separator 8 is a pipeline 11 for delivering chemically-treated feedwater to the evaporative cooling system.

Steam is discharged from the separator 8 via a pipeline 12.

Each inlet of the vertical row 5 of the tubes 3 and 4 is individually connected by means of the corresponding three-way valve 6 to a service water pipeline 13 and each outlet of the vertical row 5 of the tubes 3 and 4 is in turn connected with the aid of a corresponding three-way valve 9 individually to tubes 14 for draining waste water into drain pipeline 15.

The cooling water supply header 7 mounts a water drain valve 16.

The herein-proposed device operates in the following manner.

Prior to being put into service, the evaporative cooling device is subjected to washing, first with service and then with chemically-treated (purified) water to clean it from foreign matters and dirt. In this case service-water washing is effected with the three-way valves 6 and 9 being placed in a position enabling the supply of service water from the pipeline 13 via the tubes 3 and 4 of the coolers 1 and discharge tube 14 into the drain tube 15. In the second case, i.e. during washing with chemically-treated water, said valves 6 and 9 are set to a position ensuring the supply of chemically-treated water from the separator 8 through the header 7, tubes 3 and 4 and header 10 to the water drain valve 16, for draining water from the lower points of the header 7.

Washing completed, the valves 6 and 9 are placed in a position ensuring the operation of the evaporative cooling system and the valve 16 is closed.

Before operation, the device for evaporative cooling is filled with chemically-treated water from the central pumping station of a deaerating unit, the water being supplied through the pipeline 11 into the separator 8.

As the heat liberated during the technological process is absorbed by the plates 2 of the cooler 1, water enclosed in the tubes 3 and 4 is heated.

Heating results in a change in water specific gravity with the water being set in motion owing to a difference in specific gravities of the water in the supply header 7 and in the tubes 3 and 4, i.e. natural circulation of water in cooling loops is initiated.

It occurs because a lighter steam-water mixture displaced by water from the separator 8 and supply header 7 is directed through the discharge header 10 into the steam space of the separator 8.

In the steam space of the separator 8 steam is separated from the water, with the steam being passed along the pipeline 12 and with the water falling onto the water surface of the water space of the separator 8 to be again admitted into the circulation loops.

To cover losses in the form of evaporated water, chemically-treated water is added to the separator 8 from the pipeline 11.

If one of the tubes 3 attached in the cooling plates 2 or one of their connecting pipes 4 fails (breaks out, burns out, etc.), the vertical tube row 5, wherein the damaged tube is located, is changed over to service-water cooling to enable repairs.

To this end the three-way valve 6 mounted at the inlet of the damaged tube row 5 is set to a position when it cuts off the supply of cooling water from the header 7 to said tube row 5 and ensures the delivery of service water from the pipeline 13 at a pressure within the separator 8 being equal to the atmospheric one.

The corresponding three-way valve 9 set up at the outlet of said row 5 of the tubes 3 and 4 is also placed in a position ensuring water draining via the tubes 14 to the drain pipeline 15.

In this case all the remaining vertical rows of the tubes 3 and 4 of the coolers 1 of the evaporative cooling system keep working.

Thus, the proposed device for the evaporative cooling of metallurgical units would enable in case one or a plurality of the tubes 3 and 4 of the coolers 1 fail, only the damaged tube row 5 to be disconnected from the evaporative cooling water system without interfering with normal operation of other tubes and normal cooling of the coolers 1 and hence, not affecting adversely the proper course of the technological process.

What we claim is:

1. A device for evaporative cooling of metallurgical units which is a closed natural circulation cooling water system including: coolers accommodating several rows of vertical tubes for coding water; a separating tank adapted for separating steam from water and acting also as a water storage; a header connected individually to each inlet of said rows of the cooler tubes and adapted for supplying cooling water from said separating tank to said tubes; a header connected individually to each outlet of said rows of the cooler tubes and adapted to discharge steam-water mixture from said tubes into said separating tank; a service water supply pipeline connected also individually to each inlet of said rows of the cooler tubes; a drain pipeline connected also individually to each outlet of said cooler tube rows and adapted for draining water from said tubes; cutoff means mounted each at the inlet and outlet of said cooler tube rows and made so that with the means set to one position both the inlets and outlets of said tube rows are coupled with said header for supplying cooling water from said separating tank and with said header discharging steam-water mixture into the separating tank accordingly, while in another position they are connected to said service-water supply pipeline and to said drain pipeline, said cutoff means comprising three-way valves.

* * * * *